US011304488B2

(12) United States Patent
Savoulidis

(10) Patent No.: US 11,304,488 B2
(45) Date of Patent: Apr. 19, 2022

(54) HANDLE FASTENER FOR PERSONAL BAG

(71) Applicant: Megalini LLC, Brooklyn, NY (US)

(72) Inventor: Anastasia Savoulidis, Brooklyn, NY (US)

(73) Assignee: Megalini LLC, Brooklyn, NY (US)

( * ) Notice: Subject to any disclaimer, the term of this patent is extended or adjusted under 35 U.S.C. 154(b) by 347 days.

(21) Appl. No.: 16/396,055

(22) Filed: Apr. 26, 2019

(65) Prior Publication Data

US 2020/0337429 A1 Oct. 29, 2020

(51) Int. Cl.
*A45C 13/26* (2006.01)
*A45C 3/06* (2006.01)

(52) U.S. Cl.
CPC ..... *A45C 13/26* (2013.01); *A45C 3/06* (2013.01)

(58) Field of Classification Search
CPC ..... A45C 13/26; A45C 3/06
See application file for complete search history.

(56) References Cited

U.S. PATENT DOCUMENTS 83,486 A * 10/1868 Griggs ..... A44C 1/00 63/20
1,189,480 A 7/1916 Pomper
1,370,636 A 3/1921 Dwyer
D150,612 S * 8/1948 Katz ..... A47G 29/083 D11/44
2,723,696 A 11/1955 Kase
2,954,593 A * 10/1960 Matelan ..... A44C 15/003 24/13
3,297,119 A 1/1967 Viol
3,346,155 A 10/1967 Oechsle
3,802,613 A 4/1974 Droeger
3,938,716 A 2/1976 Jackson et al.
4,125,212 A 11/1978 Courchesne
4,153,092 A 5/1979 Haslam
4,240,480 A 12/1980 Strobel
4,273,274 A 6/1981 Freistadt
4,810,102 A 3/1989 Norton
4,856,570 A 8/1989 Rushing et al.
4,989,656 A 2/1991 Derfler
5,407,111 A 4/1995 Lanouette et al.
5,415,332 A 5/1995 Kliot
5,577,652 A 11/1996 Cooper
5,743,448 A 4/1998 Tsai
5,950,893 A 9/1999 Heggeland
5,957,354 A 9/1999 Mentken
5,967,390 A 10/1999 Goryl
6,092,702 A 7/2000 Cassidy, IV
6,161,738 A 12/2000 Norris
6,220,493 B1 4/2001 Iijima et al.
6,286,461 B1 9/2001 Martz
6,311,884 B1 11/2001 Johnson
7,160,028 B1 1/2007 Linday
(Continued)

*Primary Examiner* — Tri M Mai
(74) *Attorney, Agent, or Firm* — Carter, DeLuca & Farrell LLP; George Likourezos

(57) ABSTRACT

A handle fastener for a personal bag having two or more handles includes a body having a top and a bottom, a first arm and a second arm, and a ring. The first arm is coupled to the bottom of the body and pivotally coupled to the second arm to selectively grasp one or both of the handles of the personal bag for coupling the handles together. The ring is slidably coupled to the second arm and configured to selectively attach to the personal bag.

6 Claims, 11 Drawing Sheets

(56) References Cited

U.S. PATENT DOCUMENTS

| | | | | |
|---|---|---|---|---|
| D599,105 | S * | 9/2009 | Castaline | D3/207 |
| 8,479,536 | B2 * | 7/2013 | Masterson | A44C 5/2095 63/1.16 |
| 8,668,177 | B2 * | 3/2014 | Stein | A47G 29/083 248/308 |
| 9,439,476 | B2 * | 9/2016 | Riccardi | A43B 23/24 |

* cited by examiner

HANDLE FASTENER FOR PERSONAL BAG

TECHNICAL FIELD

The present disclosure relates to handle fasteners, and more particularly to handle fasteners for coupling handles of a personal bag.

BACKGROUND

Personal handbags of various shapes and sizes are well known and popular items in the women's and men's accessory market. These personal bags typically include two handles for carrying these bags over one side of the body, either in the hand or on the shoulder. In some instances, the two handles of the personal bag are configured to be carried over the back on both shoulders. In order to carry the personal bag, configured to be carried over the back on both shoulders, over one shoulder conversion of the personal bag is required.

SUMMARY

In accordance with an aspect of the disclosure, a handle fastener for a personal bag having two or more handles is provided and includes a body having a top and a bottom, a first arm and a second arm, and a ring. The first arm is coupled to the bottom of the body and pivotally coupled to the second arm to selectively grasp at least one of the two or more handles of the personal bag for coupling the two or more handles together. The ring is slidably coupled to the second arm and configured to selectively attach to the personal bag.

In aspects, the first arm of the handle fastener may have a first member that may be configured to intimately mate with a second member of the second arm.

In aspects, the ring of the handle fastener may be configured to selectively attach to the personal bag at a location on the personal bag other than the handles of the personal bag.

In aspects, the body of the handle fastener may be circular.

In aspects, the handle fastener may have a series of loops disposed along an outer perimeter of the body of the handle fastener. Each loop of the series of loops may be configured to couple to one or more charms.

In aspects, the bottom of the body of the handle fastener may be configured to adhere to the personal bag at a location on the personal bag separate from the two or more handles.

In accordance with another aspect of the disclosure, a personal bag is provided and includes a first handle. The first handle includes a first fastener and a second handle including a second fastener. The first and second fasteners of the personal bag may be selectively connectable to one another, coupling the first and second handles together. The first fastener and the second fastener are centrally disposed along the first handle and the second handle.

In aspects, the first handle and the second handle may be configured to be adjusted to different configurations.

In aspects, the first fastener and the second fastener may be configured to operate as a turn lock.

In aspects, the first fastener and the second fastener are configured to operate as a thumb lock.

In aspects, the first fastener and the second fastener may be configured to operate as a cinch lock.

In aspects, the personal bag may have a third fastener configured to selectively grasp the first or second handles for coupling the first and second handles together.

In aspects, the third fastener may have a top and a bottom, a first arm and a second arm, the first arm may be coupled to the bottom and pivotally coupled to the second arm, the second arm including a ring may be slidably coupled thereto, the ring may be configured to attach to at least one of the first or second handles of the personal bag.

In aspects, the first arm may have a first member configured to intimately mate with a second member of the second arm.

In aspects, the ring of the handle fastener may be configured to selectively adhere to the personal bag when not attached to the first or second handles of the personal bag.

In aspects, the third fastener of the personal bag may have a series of loops disposed around an outer perimeter of the third fastener.

In aspects, the top of the third fastener may be configured to adhere to the personal bag at a location on the personal bag separate from the first and second handles.

BRIEF DESCRIPTION OF THE DRAWINGS

The above and other aspects, features, and advantages of the present disclosure will become more apparent in light of the following detailed description when taken in conjunction with the accompanying drawings, in which.

DETAILED DESCRIPTION

Figure 1A:
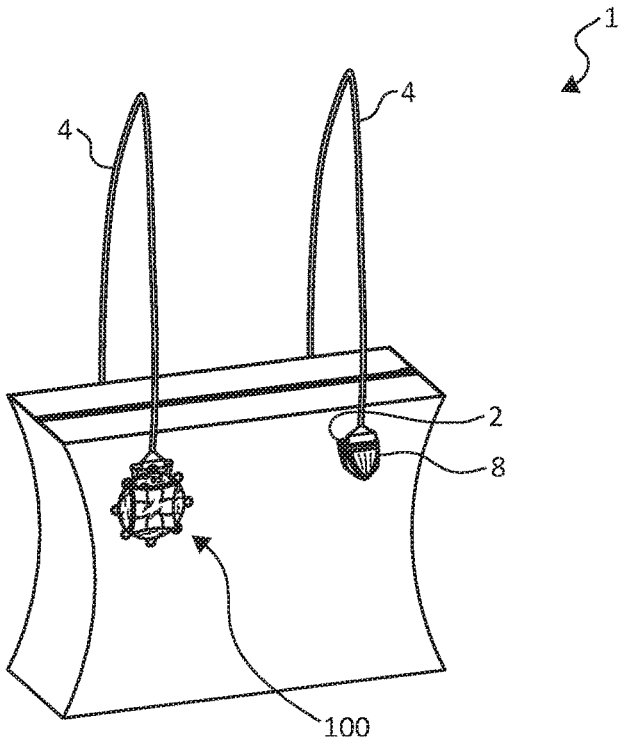
FIG. 1A and FIG. 1B are front and rear perspective views, respectively, illustrating one embodiment of a personal bag with a handle fastener.

Particular embodiments of the disclosure are described hereinbelow with reference to the accompanying drawings. In the following description, well-known functions or constructions are not described in detail to avoid obscuring the present disclosure in unnecessary detail. It should be understood, however, that the disclosed embodiments are merely exemplary of the disclosure, which may be embodied in various forms. The term "personal bag" is defined herein as a handbag, pocketbook, a tote bag, or any other bag having at least two or more handles. In addition, terms such as a personal bag, and the like are used simply for the convenience of description and are not intended to limit this disclosure or provide a different definition for the term "personal bag".

The full range of designs used in the art of making personal bags, as well as the full range of methods used for closing the top of the personal bag, can be used with the present disclosure, including latching and attachment mechanisms used in the art for closing flaps and internal or external pockets. The personal bag may be constructed of any suitable material including, but not limited to, any fabric material, plastic, leather, or synthetic material.

The embodiments disclosed herein are examples of the disclosure and may be embodied in various forms. For instance, although certain embodiments herein are described as separate embodiments, each of the embodiments herein may be combined with one or more of the other embodiments herein. Specific structural and functional details disclosed herein are not to be interpreted as limiting, but as a basis for the claims and as a representative basis for teaching one skilled in the art to variously employ the present disclosure in virtually any appropriately detailed structure. Like reference numerals may refer to similar or identical elements throughout the description of the figures.

Figure 1B:
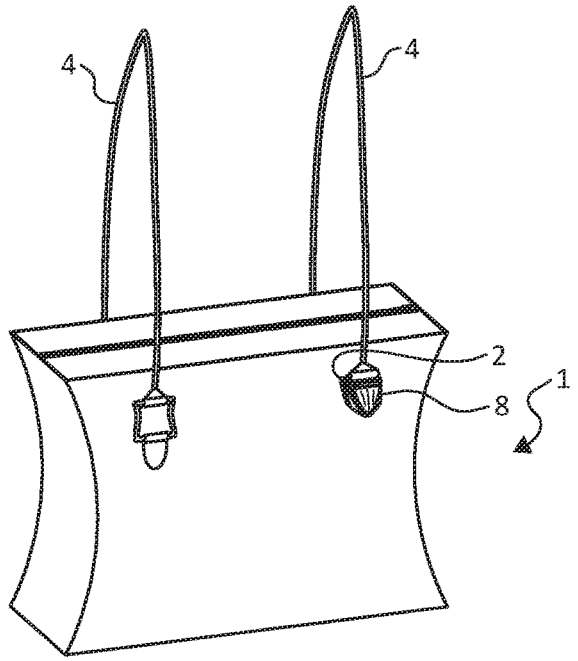
Figure 2A:
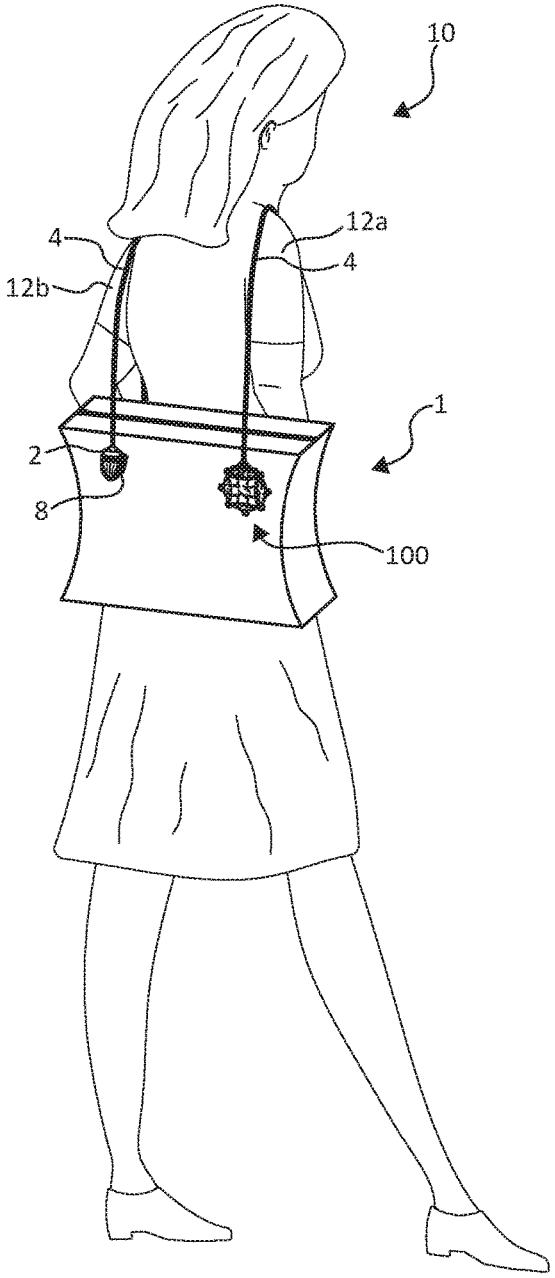
FIG. 2A and FIG. 2B are perspective views illustrating the personal bag of FIG. 1A carried on both shoulders of a user.
Figure 2B:
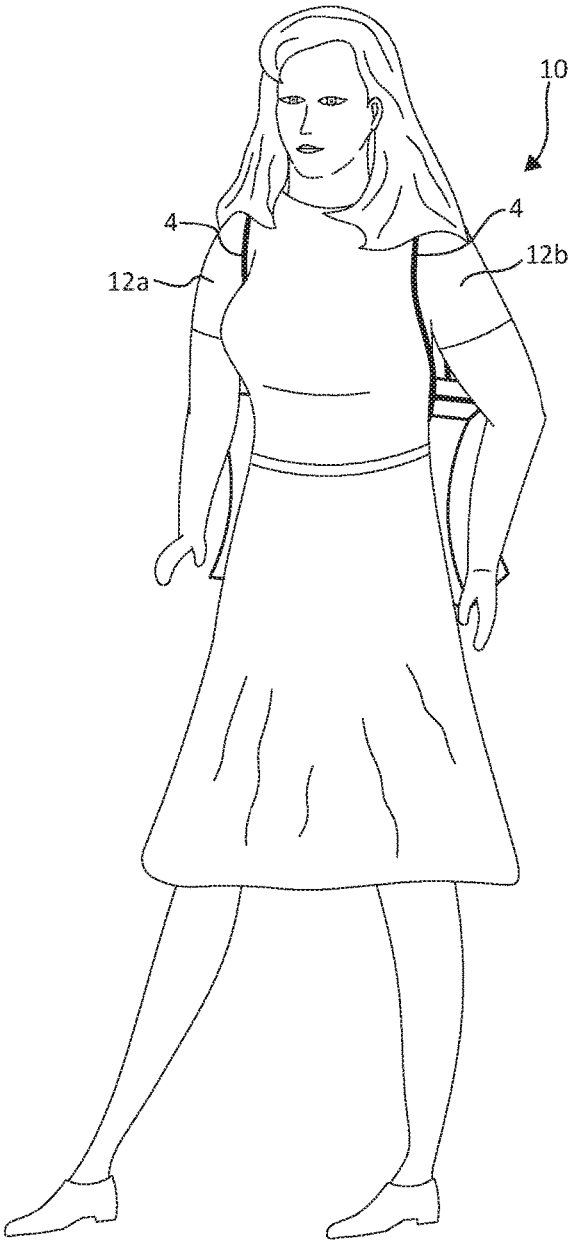

Referring now to FIG. 1A and FIG. 1B, a personal bag 1 having a handle fastener 100 is provided. The personal bag 1 includes at least two handles 4 configured to be carried over both shoulders 12*a* and 12*b* of the user 10, as seen in FIGS. 2A and 2B.

Figure 3A:
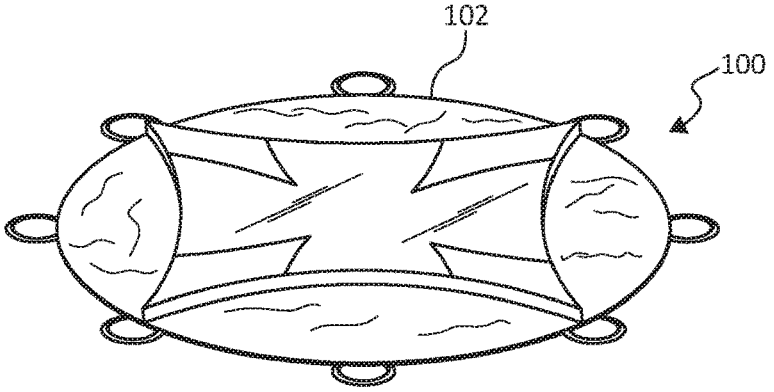
FIG. 3A is a top, perspective view illustrating the handle fastener.
Figure 3B:
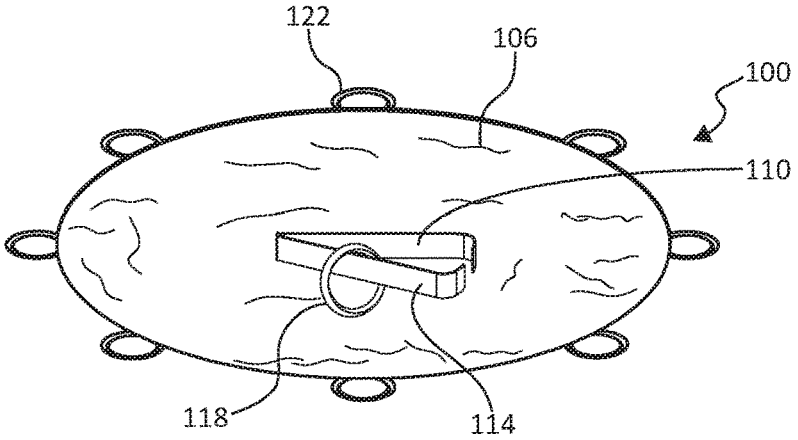
FIG. 3B is a bottom, perspective view illustrating the handle fastener.

With reference to FIG. 3A to FIG. 3B, the handle fastener 100 has a top portion 102 and a bottom portion 106 and generally includes a first arm 110, a second arm 114, a ring 118 and a series of loops 122. The first arm 110 is coupled to the bottom portion 106 of the handle fastener 100. The second arm 114 is pivotally coupled to the first arm 110 of the handle fastener 100. The first arm 110 and the second arm 114 are configured to fixedly grasp the handles 4 of the personal bag 1. The ring 118 is configured to slidably couple to the second arm 114 and selectively attach to the personal bag 1, as shown in FIG. 4A, separate from the handles 4. The series of loops 122 are disposed along an outer perimeter of the handle fastener 100 of the personal bag 1. Each loop in the series of loops 122 is configured to couple to any suitable charm (not shown). The handle fastener 100 can have any suitable polygonal shape, size, and or configuration. For example, with reference to FIG. 3A to FIG. 3C, the handle fastener 100 may be circular or non-circular (e.g., square, triangular, trapezoidal, etc.).

Figure 3C:
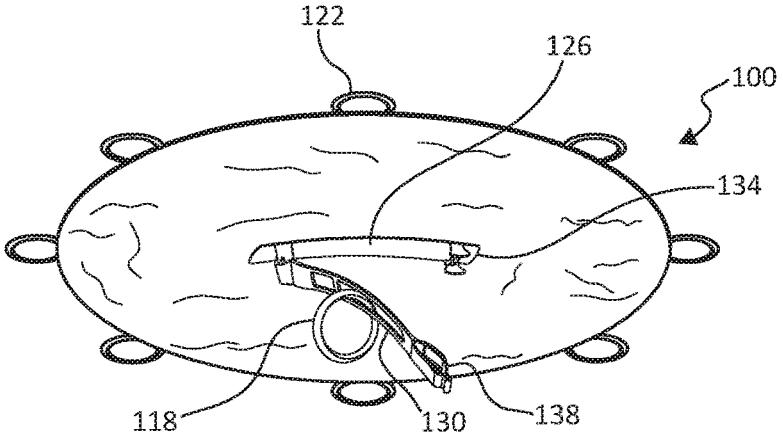
FIG. 3C is a bottom, perspective view illustrating an alternative embodiment of the handle fastener.
Figure 4A:
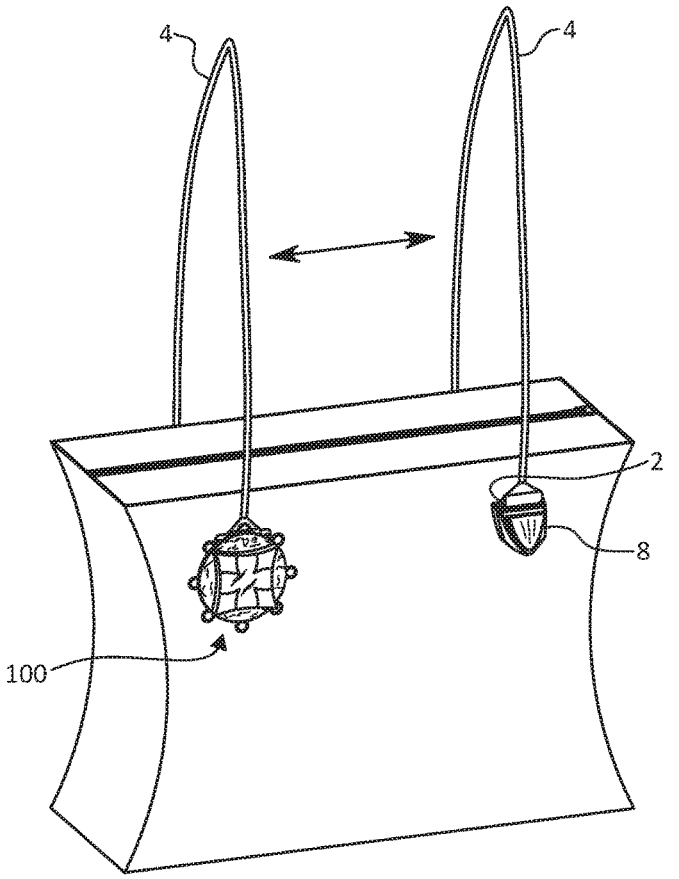
FIG. 4A and FIG. 4B are progressive views illustrating the handle fastener of FIG. 3A being positioned to couple the handles of the personal bag of FIG. 1A together.

With reference to FIG. 3C, in an alternative embodiment, a first arm 126 having a first coupler 134 is configured to couple to the bottom portion 106 of the handle fastener 100. A second arm 130 having a second coupler 138 is pivotally coupled to the first arm 126 of the handle fastener 100. The first coupler 134 of the first arm 126 and the second coupler 138 of the second arm 130 are configured to intimately mate and may be in the form of a clip (e.g., a hair clip configuration).

Figure 4B:
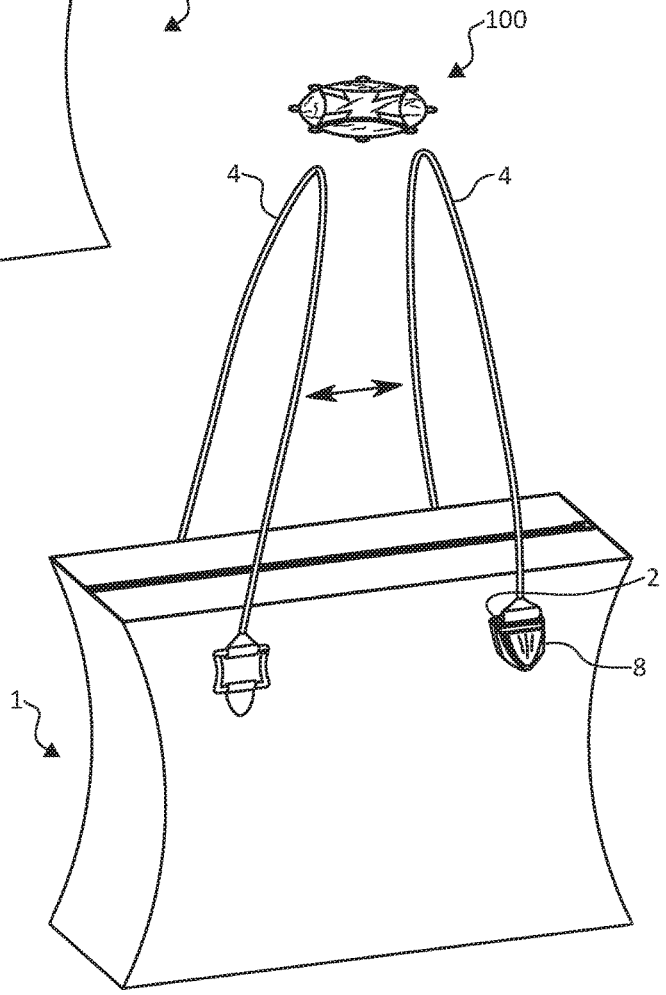
Figure 5:
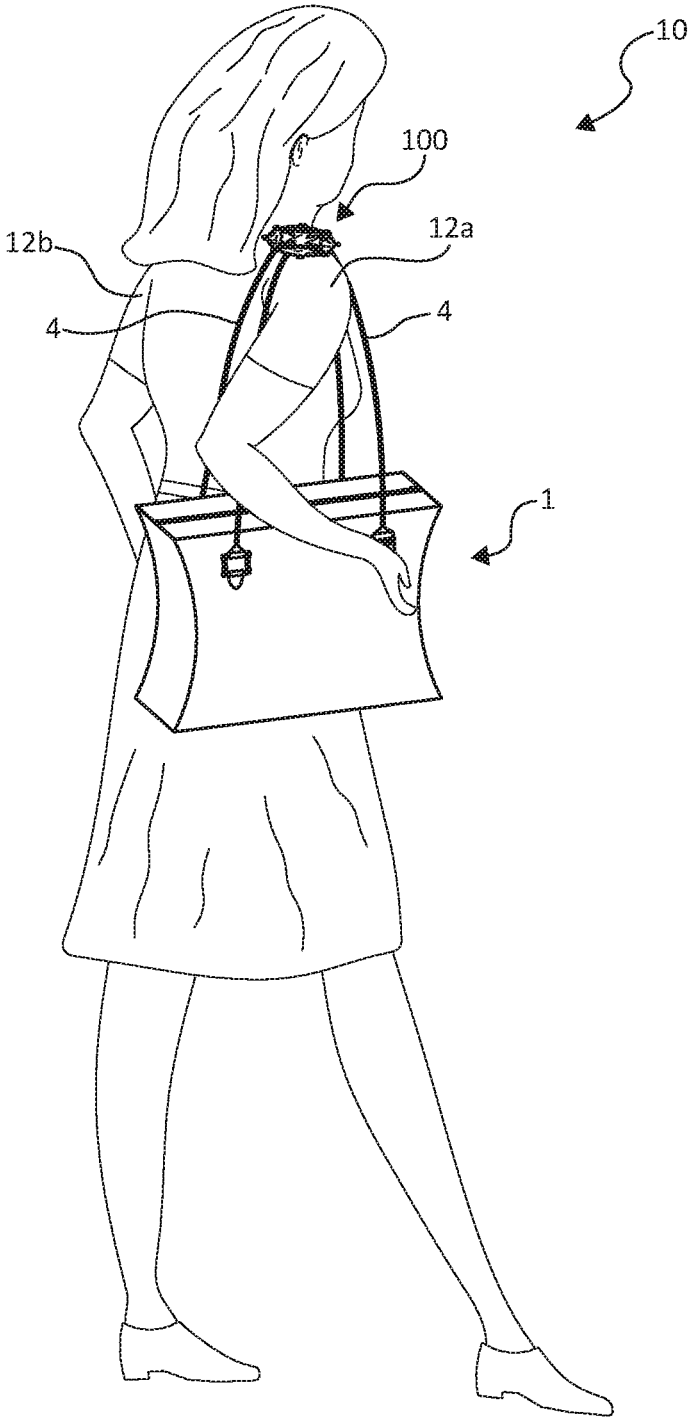
FIG. 5 is a rear, perspective view of the personal bag having the handles coupled by the handle fastener, the personal bag shown carried on one shoulder of the user.

In operation, with reference to FIG. 4A and FIG. 4B, with the personal bag 1 configured to be carried over both shoulders 12*a* and 12*b* of the user 10, the handles 4 of the personal bag 1 converge on one another. The handle fastener 100 is removed from the personal bag 1 and selectively attached via the ring 118. The first arm 110 and the second arm 114, as shown in FIG. 3B, can be moved outwardly to allow for receipt of the handles 4 of the personal bag 1. The handles 4 of the personal bag 1 can be placed in the opening of the handle fastener 100 and the first arm 110 and the second arm 114 can be moved towards one another to grasp the handles 4 of the personal bag 1. Alternatively, with reference to the embodiment shown in FIG. 3C, the first arm 126 and second arm 130 can be moved outwardly to allow for receipt of the handles 4 of the personal bag 1. The handles 4 of the personal bag 1 may be placed in the opening of the handle fastener 100 and the first arm 126 and the second arm 130 can be moved towards one another until the first coupler 134 intimately mates with the second coupler 138 grasping the handles 4 of the personal bag 1. Once the handles 4 are grasped by the handle fastener 100, with reference to FIG. 5, the personal bag 1 may be carried over one shoulder 12*a* or 12*b* of the user 10.

The personal bag 1 may be adjustable. Referring to FIG. 1A, handles 4 may further include a first bag fastener 8 and a second bag fastener 2 adhered to the two opposing sides of the personal bag 1. The first bag fastener 8 of the handles 4 are selectively attachable to either of the second bag fastener 2 adhered to on either side of the personal bag 1. When the personal bag 1 is configured to be carried over both shoulders 12*a* and 12*b* of the user 10, the first bag fastener 8 of the handles 4 are extended over the top of the personal bag 1 and are selectively attached to the second bag fastener 2 adhered to the opposite side of the handles 4.

Figure 6A:
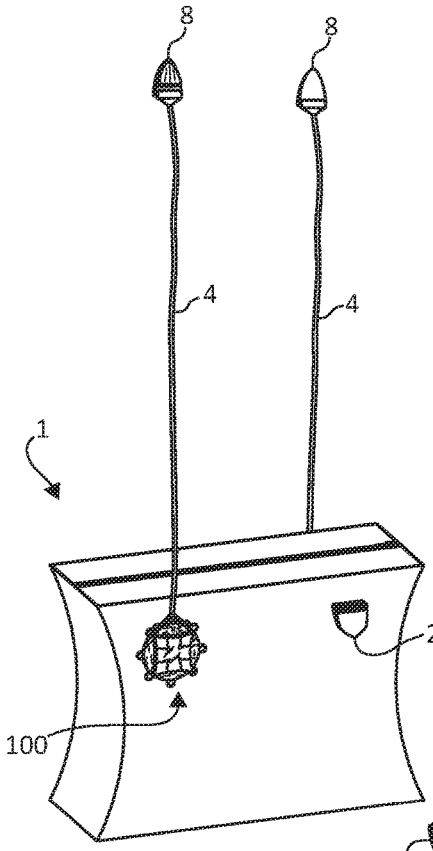
FIG. 6A-6C are progressive views illustrating the personal bag of FIG. 1A, being converted from a two shoulder configuration to a one shoulder configuration without the handle fastener.
Figure 6B:
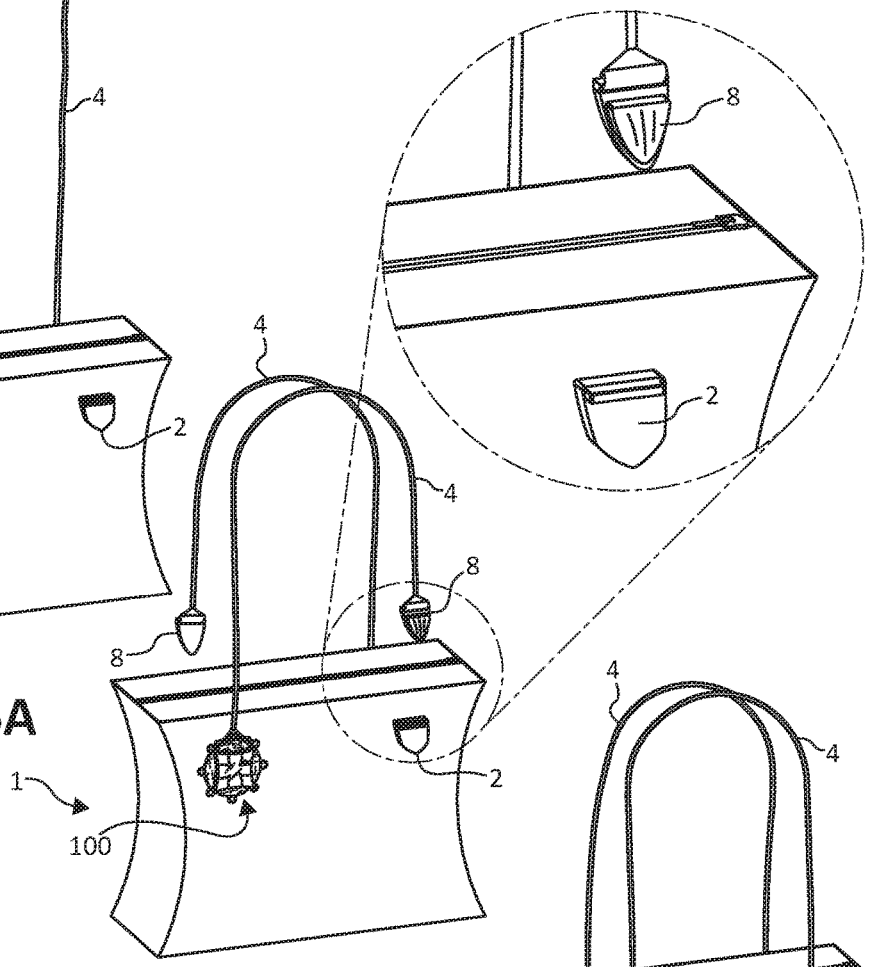
Figure 6C:
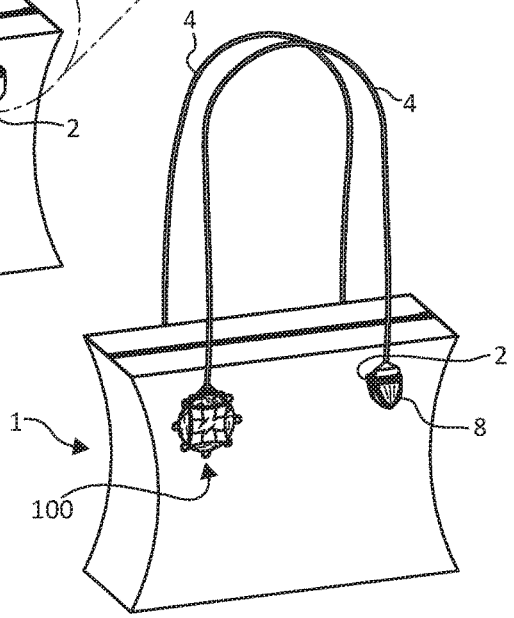
Figure 7:
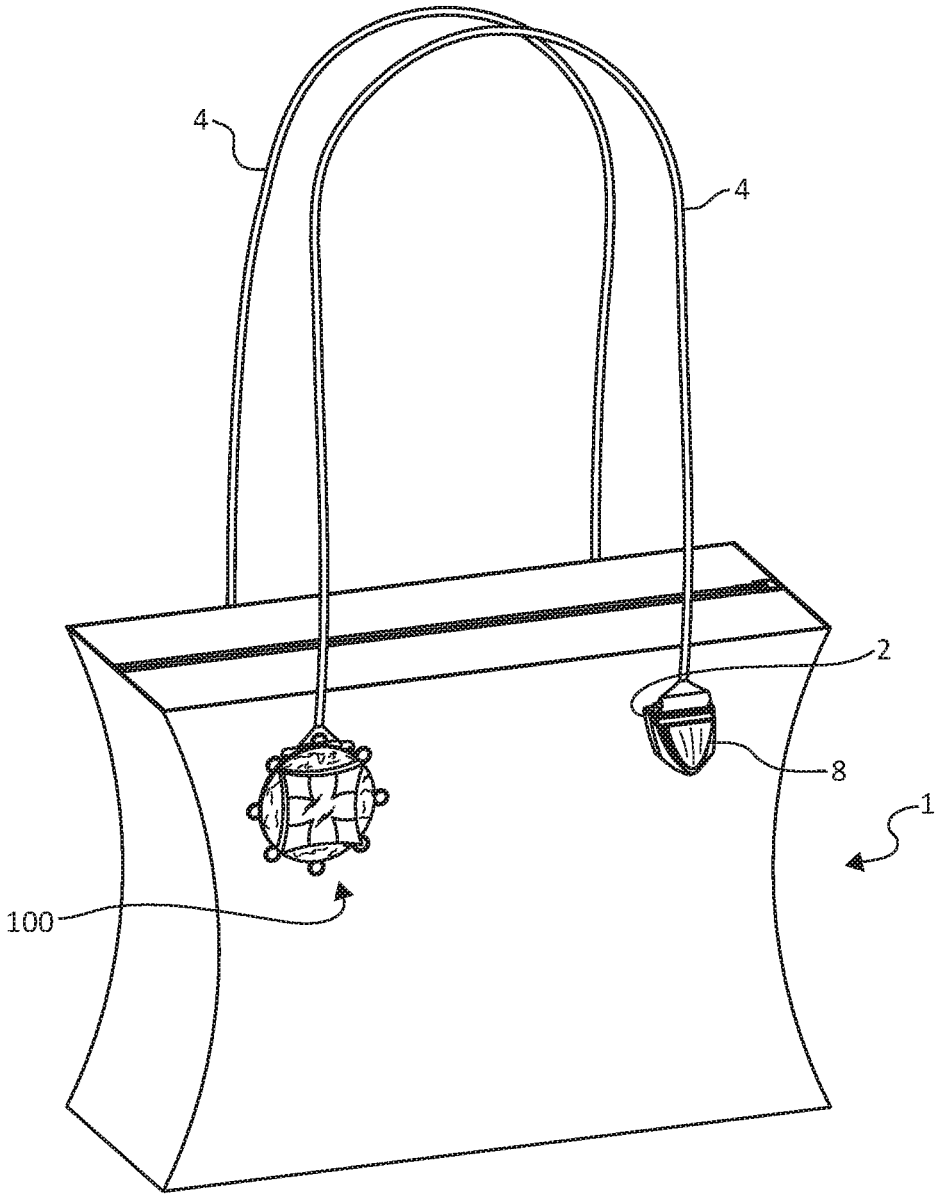
FIG. 7 is a perspective view of the converted personal bag of FIG. 6A-6C.
Figure 8:
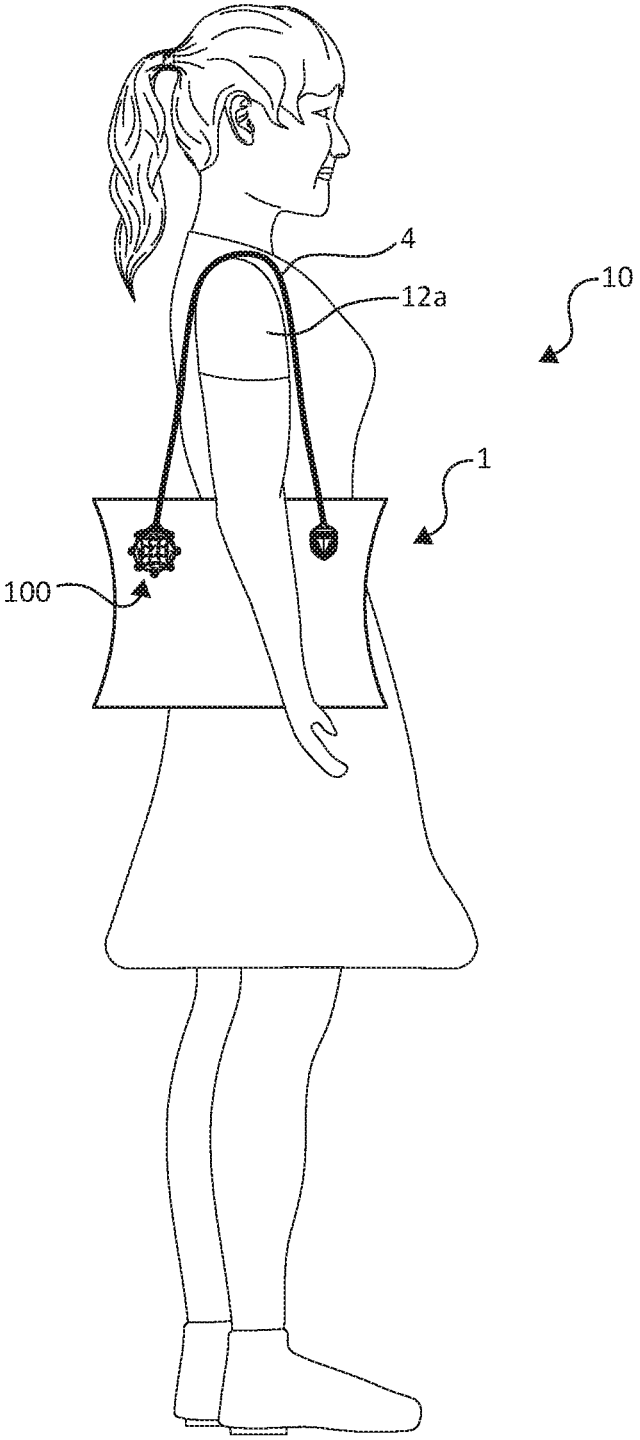
FIG. 8 is a perspective view of the converted personal bag of FIG. 6A-6C carried on one shoulder.

Referring now to FIGS. 6A, 6B, and 6C, during conversion from being configured to be carried over both shoulders 12*a* and 12*b* of the user 10 to being configured to be carried over one shoulder 12*a* or 12*b* of the user 10, as shown in FIG. 8, the first bag fastener 8 is disengaged from the second bag fastener 2. The first bag fastener 8 of the handles 4 is extended laterally to the second fastener 2 of the personal bag 1 to intimately mate together. The personal bag 1, as seen in FIG. 7 and FIG. 8, can be carried over one shoulder 12*a* or 12*b* of the user 10.

Figure 9A:
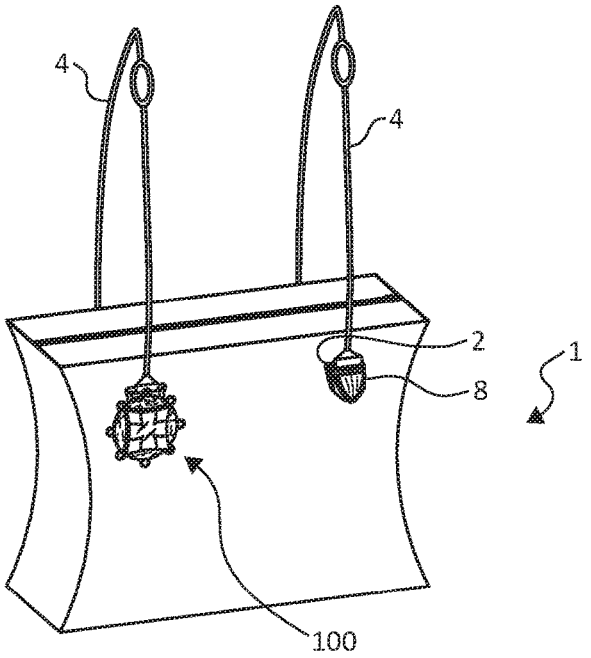
FIG. 9A is a perspective view illustrating another embodiment of a personal bag with another embodiment of a handle fastener disposed along handles of the personal bag.

Referring now to FIG. 9A, illustrating an alternative embodiment of the personal bag, each of the handles 4 further include a first fastener 200*a* and a second fastener 200*b*. The first fastener 200*a* is disposed centrally along one of the handles 4 and the second fastener 200*b* is disposed centrally along the other handle of the handles 4. The first fastener 200*a* and the second fastener 200*b* are configured to intimately mate to one another, thus coupling the handles 4 together.

Figure 9C:
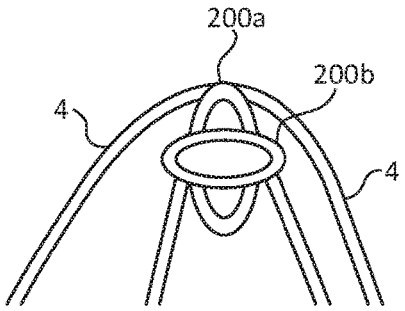
FIG. 9C and FIG. 9D are enlarged view perspective views illustrating the handle fastener of FIG. 9A in a turn lock configuration.
Figure 9B:
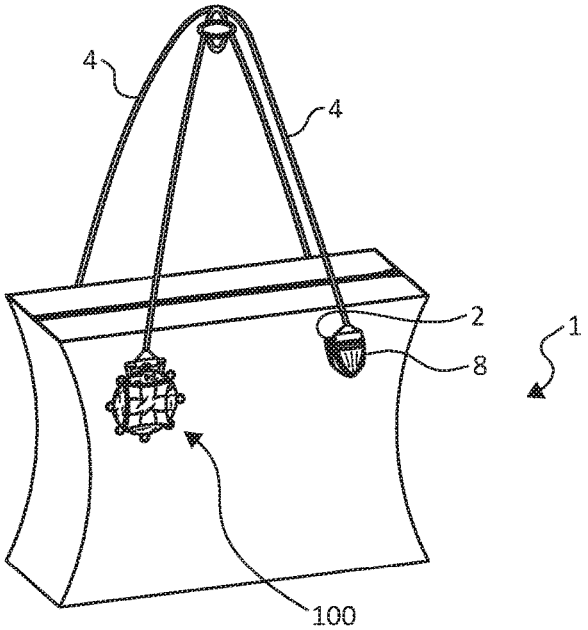
FIG. 9B is a perspective view of the personal bag of FIG. 9A with the handle fastener shown in the turn lock configuration.
Figure 9D:
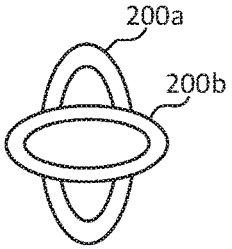

With reference to FIGS. 9C and 9D, the first fastener 200*a*, and the second fastener 200*b* are configured to operate as a turn lock. Turn locks typically operate by inserting the second fastener 200*b* through the opening of the first fastener 200*a*, whereby the second fastener is rotated either clockwise or counter clockwise thus preventing the second fastener 200*b* from disengaging from the first fastener 200*a*. Alternatively, referring to FIGS. 10C and 10D, a first fastener 300*a* and a second fastener 300*b* are configured to operate as a cinch lock. Cinch locks typically operate by inserting one side of end of the second fastener 300*b* through the opening of the first fastener 300*a* until both sides of the end of the second fastener 300*b* are through the opening of the first fastener 300*a*, whereby the second fastener 300*b* is prevented from disengaging from the first fastener 300*a*. Lastly referring to FIGS. 11C and 11D, a first fastener 400*a* and a second fastener 400*b* are configured to operate as a thumb lock. Thumb locks typically operate by inserting the first fastener 400*a* into the second fastener 400*b*, whereby the two are intimately coupled. Turn lock, cinch lock, and thumb lock are examples of suitable locking arrangements, other suitable locking arrangements are contemplated.

Figure 10A:
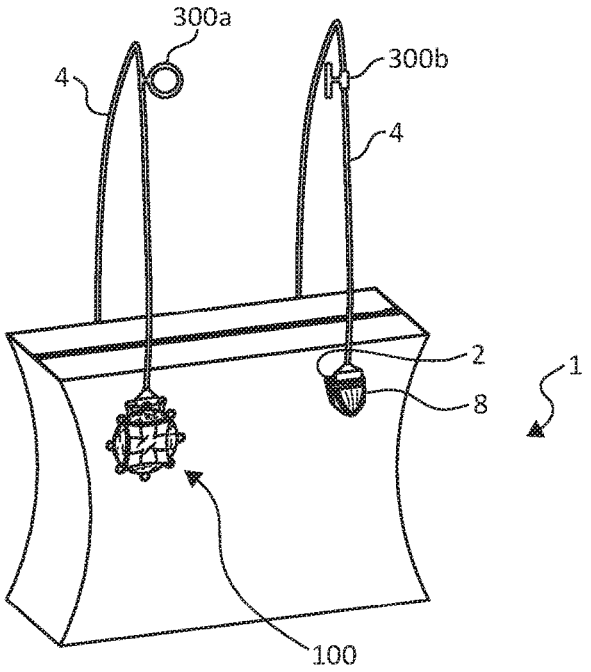
FIG. 10A is a perspective view illustrating a personal bag with another embodiment of a handle fastener disposed along handles of the personal bag.
Figure 10B:
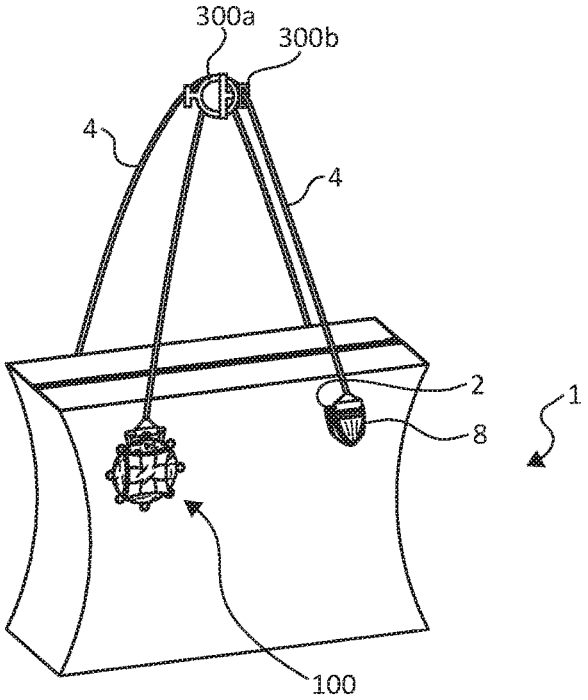
FIG. 10B is a perspective view of the personal bag of FIG. 10A with the handle fastener shown in a cinch lock configuration.
Figure 10C:
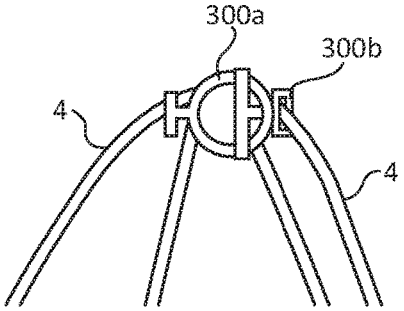
FIG. 10C and FIG. 10D are enlarged perspective views illustrating the handle fastener of FIG. 10A in the cinch lock configuration.
Figure 10D:
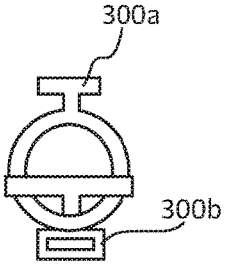
Figure 11A:
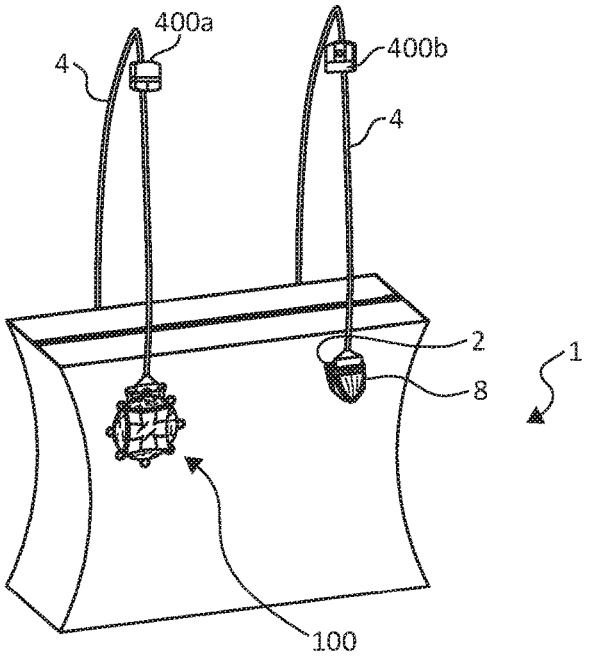
FIG. 11A is a perspective view illustrating another embodiment of a personal bag with another embodiment of a handle fastener disposed along handles of the personal bag.
Figure 11B:
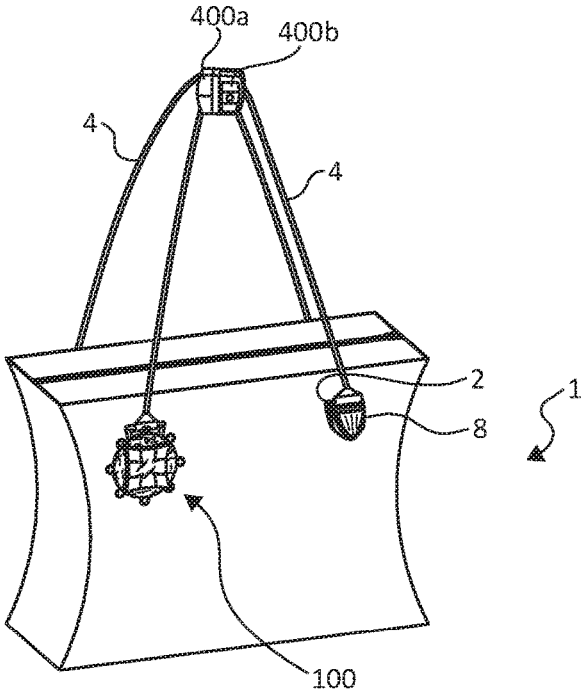
FIG. 11B is a perspective view of the personal bag of FIG. 11A with the handle fastener show in a thumb lock configuration.
Figure 11C:
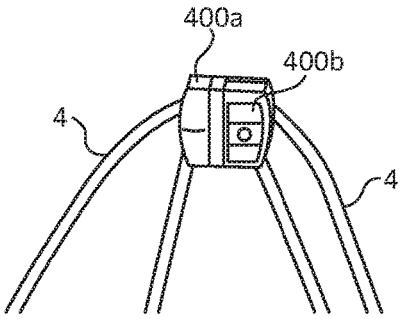
FIG. 11C and FIG. 11D are enlarged perspective views illustrating the handle fastener of FIG. 11A in the thumb lock configuration.
Figure 11D:
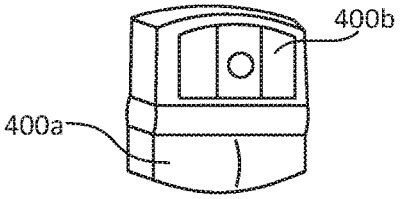

In operation, with reference to FIGS. 9B, 10B, and 11B, with the personal bag 1 configured to be carried over both shoulders 12*a* and 12*b* of the user 10, the handles 4 of the personal bag 1 are converged on one another. Rather than removing the handle fastener 100 from the personal bag 1 selectively attached via the ring 118, the first fastener 200*a* and the second fastener 200*b*, alternatively first fastener 300*a*, 400*a* and second fastener 300*b*, 400*b*, are moved towards one another until the first fastener 200*a* intimately mates with the second fastener 200*b* to thereby couple the handles 4 of the personal bag 1 together. Once the handles 4 are coupled together by the first fastener 200*a*, 300*a*, or 400*a* and the second fastener 200*b*, 300*b*, or 400*b*, the personal bag 1 may be carried over one shoulder 12*a* or 12*b* of the user 10. Alternatively, the handle fastener 100 may be removed from the personal bag 1 selectively attached via the ring 118 and in tandem or in lieu of the first fastener 200*a*, 300*a*, or 400*a* and the second fastener 200*b*, 300*b*, or 400*b* to grasp the handles 4 of the personal bag 1.

The phrases "in an embodiment," "in embodiments," "in various embodiments," "in some embodiments," or "in other embodiments" may each refer to one or more of the same or different embodiments in accordance with the present disclosure. A phrase in the form "A or B" means "(A), (B), or (A and B)." A phrase in the form "at least one of A, B, or C" means "(A); (B); (C); (A and B); (A and C); (B and C); or (A, B, and C)."

It should be understood that the foregoing description is only illustrative of the present disclosure. Various alternatives and modifications can be devised by those skilled in the art without departing from the disclosure. Accordingly, the present disclosure is intended to embrace all such alternatives, modifications, and variances. The embodiments described with reference to the attached drawing figures are presented only to demonstrate certain examples of the disclosure. Other elements, steps, methods, and techniques that are insubstantially different from those described above and/or in the appended claims are also intended to be within the scope of the disclosure.

What is claimed:

1. A handle fastener for a personal bag having at least two handles, comprising:

a body having an overside and a substantially planar underside;

a first arm disposed on the underside of the body;

a second arm pivotally coupled to the first arm, the second arm configured to selectively secure at least one of the at least two handles of the personal bag between the second arm and the underside of the body, wherein both the first arm and the second arm are sized and dimensioned to fit within a periphery of the underside of the body, such that neither the first arm nor the second arm are visible when viewed from the overside, wherein the second arm includes at least one aperture; and a ring positioned through the at least one aperture of the second arm and configured to selectively attach to the personal bag.

2. The handle fastener of claim 1, wherein the first arm includes a first member that is configured to selectively couple with a second member of the second arm.

3. The handle fastener of claim 1, wherein the ring is configured to selectively attach to the personal bag at a location on the personal bag other than the at least two handles of the personal bag.

4. The handle fastener of claim 1, wherein the body of the handle fastener is circular.

5. The handle fastener of claim 1, further comprising a series of loops disposed along an outer perimeter of the body of the handle fastener, each loop of the series of loops configured to couple to at least one charm.

6. The handle fastener of claim 1, wherein the bottom of the body of the handle fastener is configured to adhere to the personal bag at a location on the personal bag separate from the at least two handles.

* * * * *